United States Patent [19]

Reen et al.

[11] 4,028,094

[45] June 7, 1977

[54] STAINLESS STEEL POWDER

[75] Inventors: Orville W. Reen, New Kensington; Donald J. McMahon, Export, both of Pa.

[73] Assignee: Allegheny Ludlum Industries, Inc., Pittsburgh, Pa.

[22] Filed: Oct. 29, 1975

[21] Appl. No.: 626,945

[52] U.S. Cl. ..... 75/.5 BA; 75/.5 C

[51] Int. Cl.[2] ..... B22D 23/08; C22C 38/44

[58] Field of Search ..... 75/.5 BA, .5 C, 128 W

[56] References Cited

UNITED STATES PATENTS

| | | | |
|---|---|---|---|
| 2,398,702 | 4/1946 | Fleischmann | 75/128 W |
| 2,826,805 | 3/1958 | Probst et al. | 75/.5 BA |
| 3,301,668 | 1/1967 | Cope | 75/128 W |
| 3,598,567 | 8/1971 | Grant | 75/.5 BA |
| 3,716,354 | 2/1973 | Reen | 75/.5 C |

*Primary Examiner*—W. Stallard

*Attorney, Agent, or Firm*—Vincent G. Gioia; Robert F. Dropkin

[57] ABSTRACT

Atomized, prealloyed stainless steel powder having an apparent density of at least 2.0 g./cu.cm. The steel consists essentially of, by weight, up to 0.3% carbon, up to 2.0% manganese, up to 0.05% phosphorus, up to 0.04% sulfur, up to 2.0% silicon, 17.5 to 18.0% chromium, 10.0 to 14.0% nickel, 2.5 to 3.0% molybdenum, balance iron and residuals.

4 Claims, No Drawings

STAINLESS STEEL POWDER

The present invention relates to atomized, prealloyed stainless steel powder.

The American Iron and Steel Institute has classified a number of stainless steels according to chemistry. One such classification is AISI Type 316L. Specific compositions for wrought and cast products made from such an alloy are chosen after a consideration of several factors, which include: (1) ease of hot rolling; (2) ease of cold rolling; (3) ease of fabrication; (4) degree of corrosion resistance; and (5) cost. As all of these factors, namely (1) through (3), are not just considerations for parts made from metal powders, and as the corrosion resistance of powder parts differs from that of fully dense wrought and cast parts; different criteria should be applied in choosing a composition for powder parts, as contrasted to wrought and cast parts. In the past, the powder metal industry would generally use the same analysis as that used throughout the rest of the metals industry. Through this invention there is now provided a 316L type steel particularly suitable for powder parts requiring superior corrosion resistance.

It is accordingly an object of the present invention to provide atomized, prealloyed stainless steel powder, suitable for use in the manufacture of sintered powder parts requiring superior corrosion resistance to the chloride ion.

The present invention provides an atomized, prealloyed stainless steel powder having an apparent density of at least 2.0 g./cu.cm.. The steel consists essentially of, by weight, up to 0.3% carbon, up to 2.0% manganese, up to 0.5% phosphorus, up to 0.04% sulfur, up to 2.0% silicon, 17.5 to 18.0% chromium, 10.0 to 14.0% nickel, 2.5 to 3.0% molybdenum, balance iron and residuals. A particularly good steel within said broad range contains from 17.60 to 17.85% chromium and from 2.60 to 2.85% molybdenum. A preferred nickel range is from 12.75 to 13.6%.

As noted in the preceding paragraph, the powder of the subject invention must have an apparent density of at least 2.0 g./cu.cm.. Particles of a powder having a lower apparent density tend to bridge or stick together, and thereby exhibit poor flow characteristics. Moreover, powder with a lower apparent density necessitates undesirably large fill volumes.

Example 4 of U.S. Pat. No. 3,449,115 discloses stainless steel powder having 18% chromium, 12% nickel and 3% molybdenum. The powder described therein is not, however, atomized, prealloyed powder; but rather, powder produced through chemical reduction. Moreover, said powder has an average particle size below 1 micron, and as a result thereof, an apparent density below 2 g./cu.cm. The powder of the present invention has an average particle size in excess of 50 microns.

The following examples are illustrative of several aspects of the invention.

Four atomized, prealloyed powders (A through D) having an apparent density in excess of 2 g./cu.cm. were prepared. The chemistry of the powders appears hereinbelow in Table I.

TABLE I

| | Composition (wt. %) | | | | | | | | |
|---|---|---|---|---|---|---|---|---|---|
| Powder | C | Mn | P | S | Si | Cr | Ni | Mo | Fe |
| A | 0.010 | 0.02 | 0.008 | 0.003 | 0.83 | 16.30 | 10.25 | 2.80 | Bal. |
| B | 0.024 | 0.13 | 0.010 | 0.004 | 0.79 | 17.69 | 10.15 | 2.76 | Bal. |
| C | 0.017 | 0.18 | 0.013 | 0.020 | 0.79 | 17.83 | 13.30 | 2.17 | Bal. |
| D | 0.012 | 0.04 | 0.006 | 0.003 | 0.82 | 17.85 | 13.53 | 2.84 | Bal. |

Twenty compacts of each powder were formed by: blending the respective powders with 0.5 weight percent of stearic acid, a well known lubricant; by double-action pressing of the powder in a 1-inch diameter die; and by sintering the green compacts in hydrogen at 2200° F. The density of the sintered compacts was approximately 6.4 g./cu.cm.

Each group of 20 compacts was tested by subjecting it to a 5% neutral NaCl spray in accordance with ASTM Designation B117. Frequent examinations were made to observe when rust occurred. Testing was continued until 10 compacts in a group exhibited rust or for 500 hours, whichever occurred first. The results of the testing appears hereinbelow in Table II. Table II notes the number of compacts exhibiting rust, the number of compacts which appeared about to rust (indicated by discoloring or surface etching), and the number of compacts with no rust, for each time of observation.

TABLE II

| | Resistance of Compacts to 5% Neutral Salt Spray (Hours Exposed) Rating: "0" - No Rust; "1" - Potential Rust; "2" - Rust | | | | | | | | | | | | | | |
|---|---|---|---|---|---|---|---|---|---|---|---|---|---|---|---|
| Group | 24 | 48 | 72 | 96 | 168 | 192 | 216 | 230 | 254 | 326 | 350 | 374 | 398 | 422 | 500 |
| A | 14–0 | 12–0 | 12–0 | 12–0 | | 8–0 | | | | | | | | | |
| | 1–1 | 1–1 | — | — | | 1–1 | | | | | | | | | |
| | 5–2 | 7–2 | 8–2 | 8–2 | | 11–2 | | | | | | | | | |
| B | 20–0 | 20–0 | 20–0 | 20–0 | | 12–0 | 11–0 | 10–0 | | 9–0 | 9–0 | 9–0 | 7–0 | | |
| | | | | | | 4–1 | 1–1 | 2–1 | | 2–1 | 2–1 | 2–1 | 3–1 | | |
| | | | | | | 4–2 | 8–2 | 8–2 | | 9–2 | 9–2 | 9–2 | 10–2 | | |
| C | 16–0 | 15–0 | 11–0 | 11–0 | 5–0 | | | | | | | | | | |
| | 1–1 | — | 4–1 | 2–1 | 4–1 | | | | | | | | | | |
| | 3–2 | 5–2 | 5–2 | 7–2 | 11–2 | | | | | | | | | | |
| D | 20–0 | 20–0 | 20–0 | 20–0 | | 20–0 | 20–0 | 20–0 | 20–0 | 20–0 | 20–0 | 20–0 | 20–0 | 20–0 | 20–0 |

The merit of the subject invention is readily clear from Tables I and II. Although Group A and B compacts have roughly the same chemistry, except for chromium, the corrosion resistance of Group B compacts is considerably superior to that of Group A compacts; and significantly, it is the Group B compacts, and not the Group A compacts, which satisfy the narrow chromium range for the subject invention. Likewise, although Group C and D compacts have roughly the same chemistry, except for molybdenum, the corrosion resistance of the Group D compacts is considerably superior to that of the Group C compacts; and significantly, it is the Group D compacts, and not the Group C compacts, which satisfy the narrow molybdenum range for the subject invention. Also, it is noted that the corrosion resistance of the Group D compacts is superior to that of the Group B compacts; and significantly, it is the Group D compacts, and not the Group B compacts which satisfy the narrow preferred nickel range for the subject invention.

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

I claim:

1. Atomized, prealloyed stainless steel powder consisting essentially of, by weight, up to 0.03% carbon, up to 2.0% manganese, up to 0.05% phosphorus, up to 0.04% sulfur, up to 2.0% silicon, 17.5 to 18.0% chromium, 10.0 to 14.0% nickel, 2.5 to 3.0% molybdenum, balance iron and residuals; said powder having an apparent density of at least 2.0 g./cu.cm.; said powder being suitable for use in the manufacture of sintered powder parts requiring superior corrosion resistance to the chloride ion.

2. Atomized, prealloyed stainless steel powder according to claim 1, having from 17.60 to 17.85% chromium.

3. Atomized, prealloyed stainless steel powder according to claim 1, having from 2.60 to 2.85% molybdenum.

4. Atomized, prealloyed stainless steel powder according to claim 1, having from 12.75 to 13.6% nickel.

* * * * *